US005354468A

United States Patent [19]

Richards

[11] Patent Number: 5,354,468

[45] Date of Patent: Oct. 11, 1994

[54] SANITIZING, DEODORIZING AND CLEANING UNITS FOR EVACUATION SYSTEM FILTER TRAPS

[75] Inventor: Jeffrey H. Richards, Suffern, N.Y.

[73] Assignee: Sultan Dental Products, Inc., Englewood, N.J.

[21] Appl. No.: 880,933

[22] Filed: May 11, 1992

[51] Int. Cl.[5] ..... B01D 27/08

[52] U.S. Cl. ..... 210/448; 210/452; 210/477; 210/484; 210/499; 210/501; 422/905; 433/92

[58] Field of Search ..... 433/92; 55/223, 228, 55/229, 279, 421; 210/188, 437, 443, 446, 448, 452, 455, 477, 482, 484, 485, 497.01, 497.2, 501, 499, 315; 422/5, 28, 40, 101, 104, 905

[56] References Cited

U.S. PATENT DOCUMENTS

| | | | |
|---|---|---|---|
| 2,076,935 | 4/1937 | Burckhalter | 210/499 |
| 3,396,727 | 8/1968 | Mount | 210/501 |
| 3,746,033 | 7/1973 | Keiper, III | 137/205 |
| 4,430,222 | 2/1984 | Walker | 210/477 |
| 4,770,632 | 9/1988 | Ryder et al. | 433/98 |
| 4,957,629 | 9/1990 | Smith et al. | 210/443 |
| 5,049,273 | 9/1991 | Knox | 210/443 |
| 5,094,616 | 3/1992 | Levenson | 433/93 |
| 5,169,528 | 12/1992 | Karbachsch et al. | 210/484 |

*Primary Examiner*—Robert A. Dawson
*Assistant Examiner*—W. L. Walker
*Attorney, Agent, or Firm*—Steinberg, Raskin & Davidson

[57] ABSTRACT

A sanitizing, cleaning and deodorizing unit for evacuation system filter traps of the type used in dental evacuation suction systems comprises a housing bounded by a side wall having openings that provide fluid communication with the ambient atmosphere and a body of sanitizing, cleaning and deodorizing material situated in the interior space of the housing. The material-containing housing is situated in a conventional filter trap comprising a cup-shaped unit comprising a mesh screen bottom wall. As waste material is suctioned into the filter trap, it passes through openings in the side wall of the unit housing into contact with the body of sanitizing, cleaning and deodorizing material which releases upon contact.

17 Claims, 2 Drawing Sheets

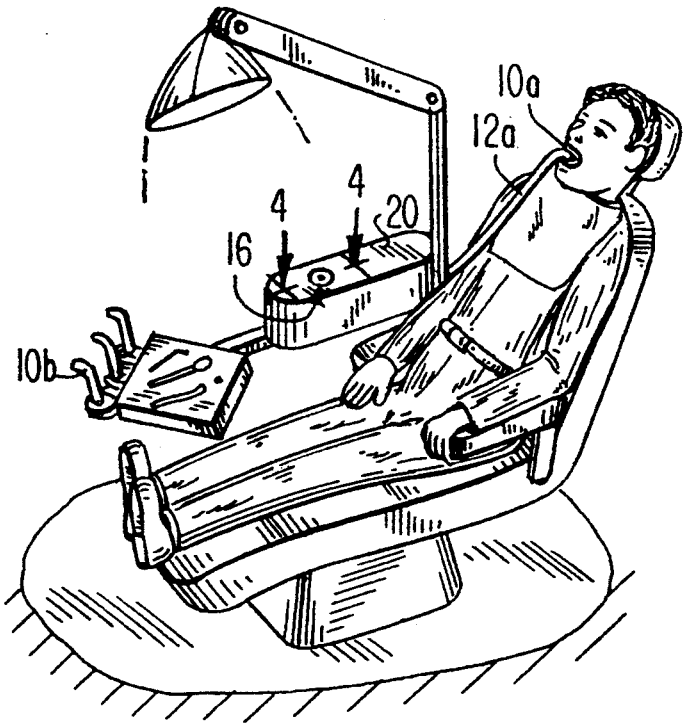
FIG.1
FIG.3
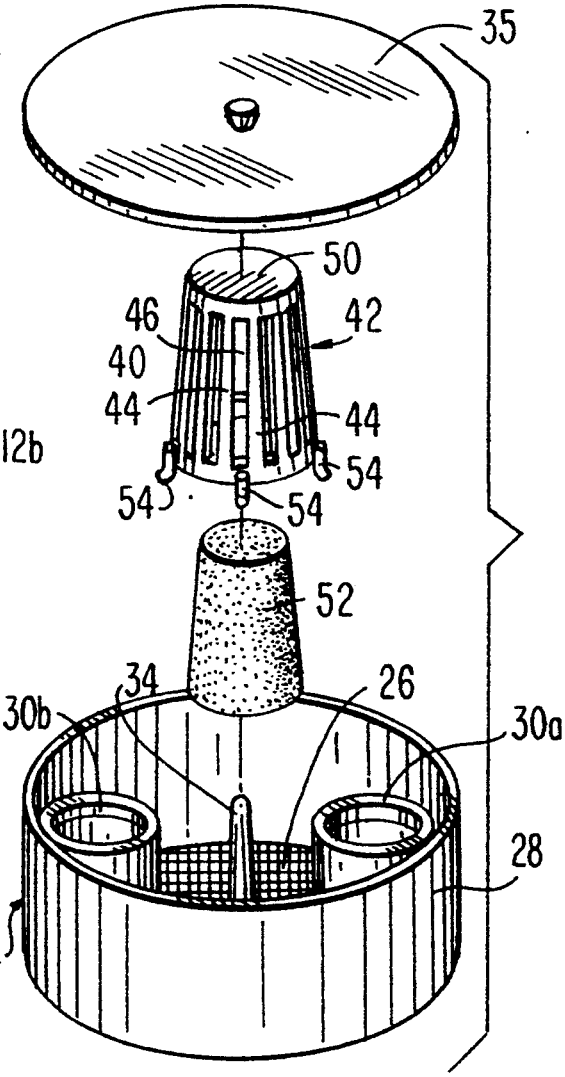
FIG.2
PRIOR ART
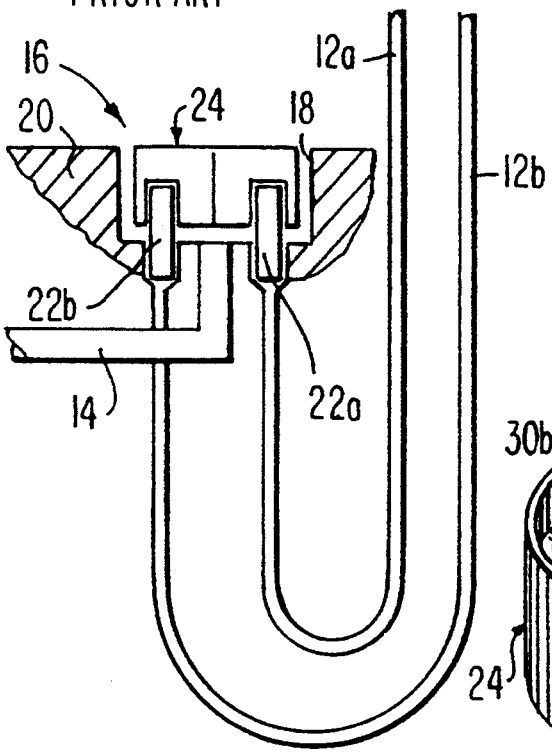

SANITIZING, DEODORIZING AND CLEANING UNITS FOR EVACUATION SYSTEM FILTER TRAPS

BACKGROUND OF THE INVENTION

This invention relates generally to evacuation suction systems and, more particularly, to apparatus for use in dental evacuation suction systems.

Evacuation suction systems used in connection with dental procedures are well known and generally comprise a suction power unit, fluid-conducting tube means which connect an intake nozzle, such as a saliva ejector or evacuation tip, with the suction power unit, and a device for entrapping liquids and/or solids interposed between the intake nozzle and the suction power unit.

In one type of system, a disposable filter trap is used to trap waste. Such filter traps comprise a cup-shaped unit formed entirely of plastic including a circular mesh screen bottom wall in which at least one suction inlet port is provided, and a substantially cylindrical solid wall surrounding the bottom wall. Liquid and solid debris suctioned from the operative field are delivered through the suction port into the cup-shaped filter trap. The liquid is suctioned through the mesh screen bottom wall to be carried out of the system while the solid debris remains within the trap. When the amount of waste present within the filter trap reaches a certain level, the trap is removed from the evacuation system and cleaned or discarded, in which case a new trap is substituted therefor.

In the operation of systems of the type described above, as the debris in the filter trap accumulates with continued use, the effective area of the mesh screen bottom decreases in size, i.e. the mesh screen becomes somewhat clogged or obstructed by the debris. This results in an unsanitary condition which is usually accompanied by an unpleasant odor.

SUMMARY OF THE INVENTION

Accordingly, one object of the present invention is to provide new and improved apparatus for use in evacuation suction filter traps which overcome certain disadvantages of conventional systems.

Another object of the present invention is to provide a new and improved sanitizing, cleaning and deodorizing unit for use in an evacuation system filter trap which includes a mesh screen through which waste material passes.

Still another object of the present invention is to provide new and sanitizing, cleaning and deodorizing units which can be used with conventional, presently available filter traps.

A further object of the present invention is to provide new and improved sanitizing, cleaning and deodorizing units for use with evacuation system filter traps which are disposable.

Yet another object of the present invention is to provide a new and improved combination of a filter trap and sanitizing, cleaning and deodorizing deodorizing unit for use in evacuation suction systems.

Briefly, in accordance with the present invention, these and other objects are attained by providing a sanitizing, cleaning and deodorizing unit comprising a housing defining an interior space bounded at least by side wall means having openings that provide fluid communication between the interior space and the ambient atmosphere, a body of sanitizing, cleaning and deodorizing material situated in the interior space of the housing, and means for connecting the housing, with the body of disinfectant material situated in said interior space thereof, to one side of the mesh screen. As waste material is suctioned into the cup-shape filter trap, it will pass through the openings in the side wall means of the unit housing into contact with the body of the sanitizing, cleaning and deodorizing material which releases upon contact. In this manner, the unsanitary condition is eliminated along with any odor emanating from the filter trap due to the waste material that accumulates within the filter trap.

In accordance with a preferred embodiment of the invention, the housing is formed with side wall means which comprise a plurality of substantially parallel ribs which are spaced from each other to define the openings in the side wall means. One or more hook or barb members are integrally formed on one end of the unit housing, each hook member being adapted to pass through a respective mesh of the mesh screen of the filter trap and grasp a side of the screen which is opposite from the screen side and which the housing is connected. In this manner, the sanitizing, cleaning and deodorizing unit is securely fastened to conventional filter traps.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a perspective view showing a patient in a dental operatory with an intake nozzle of an evacuation suction system positioned in the operative field;

FIG. 2 is a schematic view of the components of the evacuation suction system and illustrating a conventional disposable filter trap associated therewith;

FIG. 3 is an exploded perspective view of a sanitizing, cleaning and deodorizing unit in accordance with the present invention in conjunction with a conventional disposable filter trap with which it is used;

Figure 5:
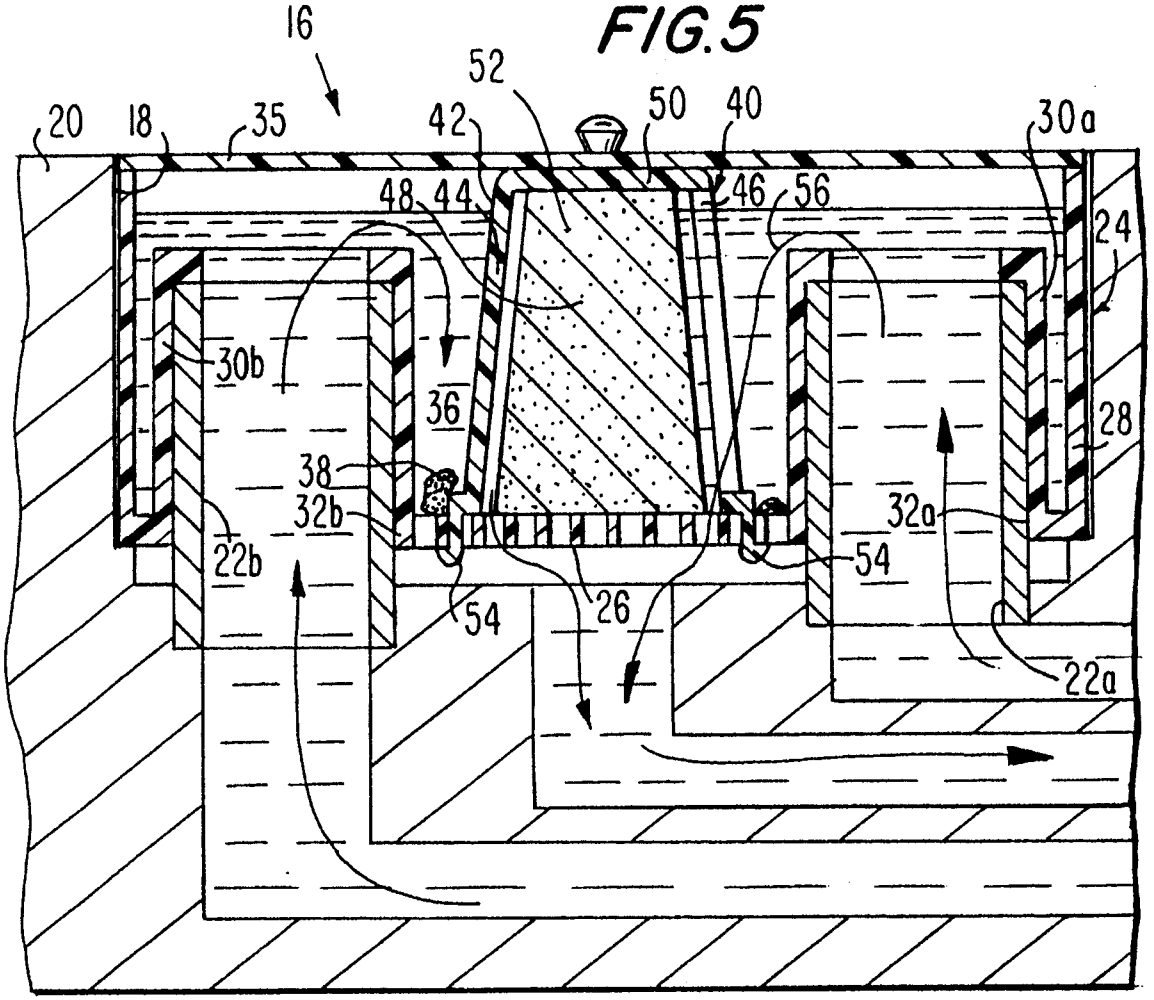
Figure 4:
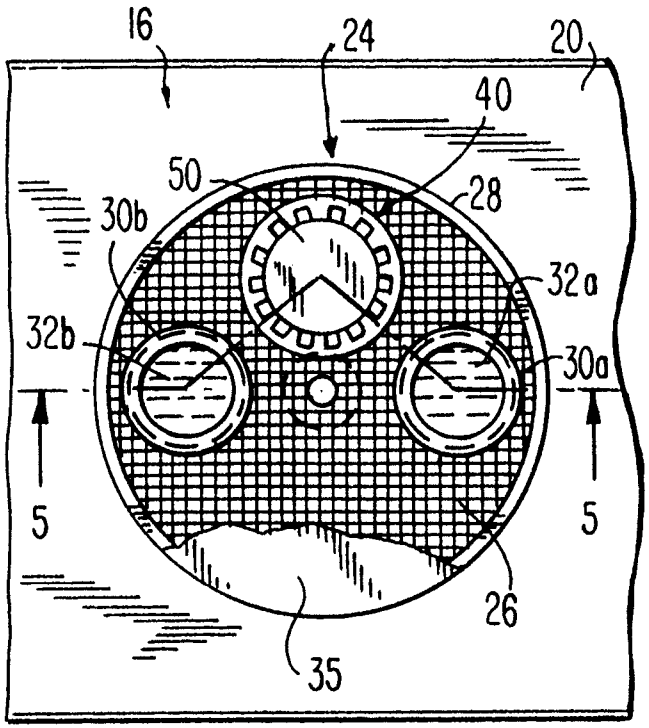

FIG. 4 is a plan view in the direction of arrows 4—4 of FIG. 1 showing the combination of the conventional filter trap and disinfecting and deodorizing unit of the present invention situated in the evacuation suction system; and FIG. 5 is a section view taken along line 5—5 of FIG. 4 showing the combination filter trap and sanitizing, cleaning and deodorizing unit in accordance with the invention in operation.

DESCRIPTION OF THE PREFERRED EMBODIMENTS

Referring now to the drawings wherein like reference characters designate identical or corresponding parts throughout the several views, and more particularly to FIGS. 1 and 2, a typical suction evacuation system used in the dental operatory comprises one or more intake nozzles, such as saliva ejector 10*a* and high volume evacuator tip 10*b* connected through fluid-conducting tube means, including flexible hoses 12*a* and 12*b* and return line 14, to a suction power unit (not shown) which may be located in a remote area and which may supply suction power to more than one operatory.

Interposed in the fluid-conducting tube means between the intake nozzles and the suction power unit are means 16 for entrapping waste material. In the illustrated embodiment, the means 16 comprises a cavity 18 formed in a console 20 situated in the operatory. Referring to FIG. 2, the downstream end of each of the flexible hoses 12*a* and 12*b* is coupled to a respective one of suction inlet ports 22*a* and 22*b* communicating with cavity 18, while the upstream end of return line 14 opens into the bottom of cavity 18. The application of suction power causes a stream of air to be withdrawn from the vicinity of the operative field in a quantity and flow rate sufficient to entrain the debris accumulating during the procedure. In this manner, a visually clear working area is provided for the dentist as well as relief for the patient from the debris which would otherwise accumulate.

It is conventional to situate a cup-shaped disposable filter trap 24 in the cavity 18 in order to trap large particles or objects entrained in the air stream, such as pieces of amalgam and other solid debris. The filter trap 24 is formed of plastic material and, as best seen in FIG. 3, generally comprises a bottom wall 26 formed of a screen mesh and an integral upstanding cylindrical side wall 28 extending around the periphery of bottom wall 26. A pair of tubular fittings 30*a* and 30*b* extend upwardly from openings 32*a* and 32*b* formed in the bottom wall 26 of the filter trap and receive the suction inlet ports 22*a* and 22*b* when the filter trap is positioned within cavity 18. An elongate handle 34 has one end connected to the bottom wall 26 and a cover 35 is provided to close the top of the trap.

Referring to FIGS. 2 and 5, in the use of the evacuation system, suction power is applied and liquid and solid debris are entrained in an airstream that is suctioned from the operative field through one of the intake nozzles 10*a* through flexible hose 12*a*. The solid and liquid debris are introduced into the cup-shaped filter trap 24 through the corresponding inlet port 22*a* and overlying fitting 30*a*. The liquid debris 36 passes through the screen mesh bottom 26 of the filter trap 24 and is suctioned out through return line 14 opening into the bottom of cavity 18. The solid debris 38 is trapped within the filter trap 24 thereby preventing the fouling of the suction power unit thereby. However, as noted above, as the solid debris 38 begins to accumulate on the bottom screen mesh wall of the filter trap 24, the screen mesh becomes more and more obstructed whereupon some of the liquid debris 36 begins to accumulate within the trap. This results in an unsanitary condition which is usually accompanied by an unpleasant odor.

In accordance with the present invention, a sanitizing, cleaning and deodorizing unit 40 is provided for use in filter traps of the type described above. Referring to FIGS. 3–5, the disinfecting and deodorizing unit 40 comprises a housing 42 formed of plastic material. The housing 42 is substantially cylindrical, tapering in the upward direction, and comprises a side wall formed of a plurality of substantially parallel ribs 44 which are spaced from each other defining openings 46 between them. The side wall formed by ribs 44 defines an interior space within housing 42 which is in fluid communication with the ambient atmosphere through the openings 46 defined between ribs 44. The housing 42 is closed at its top by wall 50 and is open at its bottom.

A body of material 52 capable of sanitizing, cleaning and/or deodorizing the particular waste being evacuated upon contact therewith is situated in the interior space 48 of housing 42. The material 52 may be any suitable composition which releases upon contact by the waste material being evacuated. For example, in the case of the type of waste or debris that is evacuated in the dental operatory, a tablet of a quaternarry ammonium, such as benzallconium chloride, or comprising borax, sodium sulfate, polyethylene glycol, dextrose, silicone, and an appropriate fragrance may be utilized.

The sanitizing, cleaning and deodorizing unit 40 comprises means for connecting the housing 42, with the body 52 of disinfectant material situated in the interior space 48 thereof, to one side of the screen mesh bottom wall 26. In particular, four hook or barb members 54 are integrally formed in diametrically opposed positions on one end of the housing 42. Each of the hook members 54 is of a size such that it can be pressed through a respective one of the meshes of the screen mesh bottom wall 26 to latch and grasp the opposite side of the screen mesh. Although four such hook members 54 are illustrated, it is understood that more or less may be provided.

As seen in FIGS. 4 and 5, the disinfecting and deodorizing unit 40 is of a size such that it fits within a conventional disposable filter trap. For example, the unit 40 preferably has a height in the range of between about 0.50 to 1.0 inches, and a diameter in the range of between about 0.35 to 0.70 inches. The cover 35 may still be applied over the filter trap 24 without being obstructed by the disinfecting and deodorizing unit 40.

In operation, as debris is introduced into the cup-shaped filter trap 24, designated by arrow 56 in FIG. 5, and as the debris begins to accumulate, it passes through the openings 46 between ribs 44 of housing 42 and into contact with the body 52 of sanitizing, cleaning and deodorizing material. The debris may then pass through the screen mesh 26 or may remain within the filter trap to be disposed of along with the filter trap.

Obviously, numerous modifications and variations of the present invention are possible in the light of the above teachings. For example, the sanitizing, cleaning and deodorizing unit of the invention may be utilized with conventional filter traps having configurations other than as shown, e.g. rectangular or the like. It is therefore to be understood that within the scope of the claims appended hereto, the invention may be practiced otherwise than as specifically disclosed herein.

I claim:

1. A sanitizing, cleaning and/or deodorizing unit for use in an evacuation system filter trap which includes a mesh screen through which waste material passes, comprising:

a housing defining an interior space bounded by at least side wall means having openings providing fluid communication between said interior space and the ambient atmosphere;

a body of material for sanitizing, cleaning and/or deodorizing said waste material situated in said interior space of said housing; and means for connecting said housing with said body of material situated in said interior space thereof to one side of said mesh screen of said filter trap, said means for connecting said housing to said mesh screen comprising at least one hook member integrally formed on one end of said housing, each of said hook members adapted to pass through a respective mesh of said mesh screen and grasp a side of said screen opposite from said screen side to which said housing is connected, whereby waste material entering said filter trap can pass through said openings in said side wall means of said housing into contact with said body of material prior to passing through said mesh screen.

2. A unit as recited in claim 1 wherein said housing comprises a substantially cylindrical member.

3. A unit as recited in claim 1 wherein said side wall means comprise a plurality of substantially parallel ribs spaced from each other, said spaces between said ribs defining said openings in said side wall means.

4. A unit as recited in claim 1 wherein said housing comprises a substantially cylindrical member and said side wall means comprise a plurality of substantially parallel ribs spaced from each other, said spaces between said ribs defining said openings in said side wall means.

5. A unit as recited in claim 4 wherein said connecting means comprise four of said hook members formed at diametrically opposed positions at one end of said housing.

6. In a filter trap for use in evacuation systems including a bottom wall comprising a mesh screen, an upstanding solid side wall surrounding the perimeter of said mesh screen bottom wall, and at least one inlet port passing said through bottom wall, the improvement comprising a sanitizing, cleaning and/or deodorizing unit comprising a housing defining an interior space bounded by at least side wall means having openings providing fluid communication between said interior space and the ambient atmosphere, a body of material for sanitizing, cleaning and/or deodorizing waste material situated in said interior space of said housing, and means connecting said housing with said body of disinfectant material situated in said interior space thereof to one side of said mesh screen.

7. The combination of claim 6 wherein said filter trap and housing are formed of plastic material.

8. The combination of claim 7 wherein said housing comprises a substantially cylindrical member.

9. The combination of claim 7 wherein said side wall means comprises a plurality of substantially parallel ribs spaced from each other, said spaces between said ribs defining openings in said side wall means.

10. The combination of claim 7 wherein said means connecting said housing to said mesh screen comprise at least one hook member integrally formed on one end of said housing, each of said hook members adapted to pass through a respective mesh of said mesh screen and grasp a side of said screen opposite from said screen side to which said housing is connected.

11. The combination of claim 7 wherein said housing comprises a substantially cylindrical member and said side wall means comprise a plurality of substantially parallel ribs spaced from each other, said spaces between said ribs defining said openings in said side wall means.

12. The combination of claim 7 wherein said housing comprises a substantially cylindrical member and wherein said means for connecting said housing to said mesh screen comprises at least one hook member integrally formed on one end of said housing, each of said hook members adapted to pass through a respective mesh of said mesh screen and grasp a side of said screen opposite from said screen side to which said housing is connected.

13. The combination of claim 7 wherein said side wall means comprise a plurality of substantially parallel ribs spaced from each other, said spaces between said ribs defining openings in said side wall means, and wherein said means for connecting said housing to said mesh screen comprises at least one hook member integrally formed on one end of said housing, each of said hook members adapted to pass through a respective mesh of said mesh screen and grasp a side of said screen opposite from said screen side to which said housing is connected.

14. The combination of claim 7 wherein said housing comprises a substantially cylindrical member, said side wall means comprise a plurality of substantially parallel ribs spaced from each other, said spaces between said ribs defining said openings in said side wall means; and wherein said means for connecting said housing to said mesh screen comprise at least one hook member integrally formed on one end of said housing, each of said hook members adapted to pass through a respective mesh of said mesh screen and grasp a side of said screen opposite from said screen side to which said housing is connected.

15. The combination of claim 7 wherein said housing has a height in the range of between about 0.50 inches to 1.0 inches.

16. The combination of claim 7 wherein said housing has a diameter in the range of between about 0.35 to 0.70 inches.

17. A filter trap for use in evacuation systems, comprising a bottom wall having a screen mesh, an upstanding solid side wall surrounding the perimeter of said screen mesh of said bottom wall, said bottom and side walls defining a filter space, at least one inlet port passing said through bottom wall, means for sanitizing, cleaning and/or deodorizing waste material situated in said filter space, and means for connecting said means for sanitizing, cleaning and/or deodorizing waste material to said screen mesh of said bottom wall, said connecting means comprising at least one hook member arranged on said means for sanitizing, cleaning and/or deodorizing waste material situated in said filter space, said connecting means being adapted to pass from a first side of said screen mesh through a respective mesh of said screen mesh and grasp a second side of said screen mesh opposite from said first side.

* * * * *